US007784894B2

(12) United States Patent
Maehira et al.

(10) Patent No.: US 7,784,894 B2
(45) Date of Patent: Aug. 31, 2010

(54) IMAGE FORMING DEVICE

(75) Inventors: Hirotoshi Maehira, Nagoya (JP); Masashi Ueda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 605 days.

(21) Appl. No.: 11/819,820

(22) Filed: Jun. 29, 2007

(65) Prior Publication Data

US 2008/0001980 A1 Jan. 3, 2008

(30) Foreign Application Priority Data

Jun. 29, 2006 (JP) ..... P2006-179063

(51) Int. Cl.
*B41J 29/38* (2006.01)

(52) U.S. Cl. ..... 347/16; 347/9; 347/20

(58) Field of Classification Search ..... 347/9, 347/16, 20, 41

See application file for complete search history.

(56) References Cited

U.S. PATENT DOCUMENTS

| | | | | |
|---|---|---|---|---|
| 5,559,930 | A * | 9/1996 | Cariffe et al. | 358/1.2 |
| 5,748,856 | A * | 5/1998 | Cariffe et al. | 358/1.2 |
| 6,155,668 | A | 12/2000 | Otsuki et al. | |
| 6,250,734 | B1 | 6/2001 | Otsuki | |
| 2009/0051944 | A1* | 2/2009 | Bracke et al. | 358/1.9 |
| 2009/0237740 | A1* | 9/2009 | Kasahara | 358/3.27 |
| 2009/0284559 | A1* | 11/2009 | Sudo et al. | 347/14 |

FOREIGN PATENT DOCUMENTS

| | | |
|---|---|---|
| JP | 11-207945 | 8/1999 |
| JP | 11-291506 | 10/1999 |
| JP | 2005-138501 | 6/2005 |

* cited by examiner

*Primary Examiner*—Ellen Kim
(74) *Attorney, Agent, or Firm*—Baker Botts, LLP.

(57) ABSTRACT

An image forming device includes a feeding unit, a recording unit, and a controller. The feeding unit includes a first feeding member and a second feeding member disposed at a downstream of the first feeding member in a feeding direction. At least one of the first feeding member and the second feeding member feeds a recording medium in the feeding direction. The recording unit is disposed between the first feeding member and the second feeding member to eject a plurality of ink droplets onto the recording medium fed between the first feeding member and the second feeding member. A plurality of ink droplets ejected onto the recording medium forms a plurality of raster lines extending in a main-scanning direction orthogonal to the feeding direction. The controller controls the recording unit to eject a plurality of ink droplets so that a plurality of first raster lines formed within a first time span has a first resolution in the feeding direction, a plurality of second raster lines formed within a second time span has a second resolution in the feeding direction, and a plurality of third raster lines formed within a third time span including a banding timing at which a trailing edge of the recording medium gets away from the first feeding member has a third resolution higher than the first resolution in the feeding direction. The second time span follows the first time span and the third time span follows the second time span. The second resolution is higher than the first resolution and lower than the third resolution.

17 Claims, 13 Drawing Sheets

IDEAL DOT FORMATION IN NORMAL ARRANGEMENT

DOT FORMATION IN NORMAL ARRANGEMENT
WITH SKIP DURING SHEET FEEDING PROCESS

IDEAL DOT FORMATION IN STAGGERED ARRANGEMENT

DOT FORMATION IN STAGGERED ARRANGEMENT
WITH SKIP DURING SHEET FEEDING PROCESS

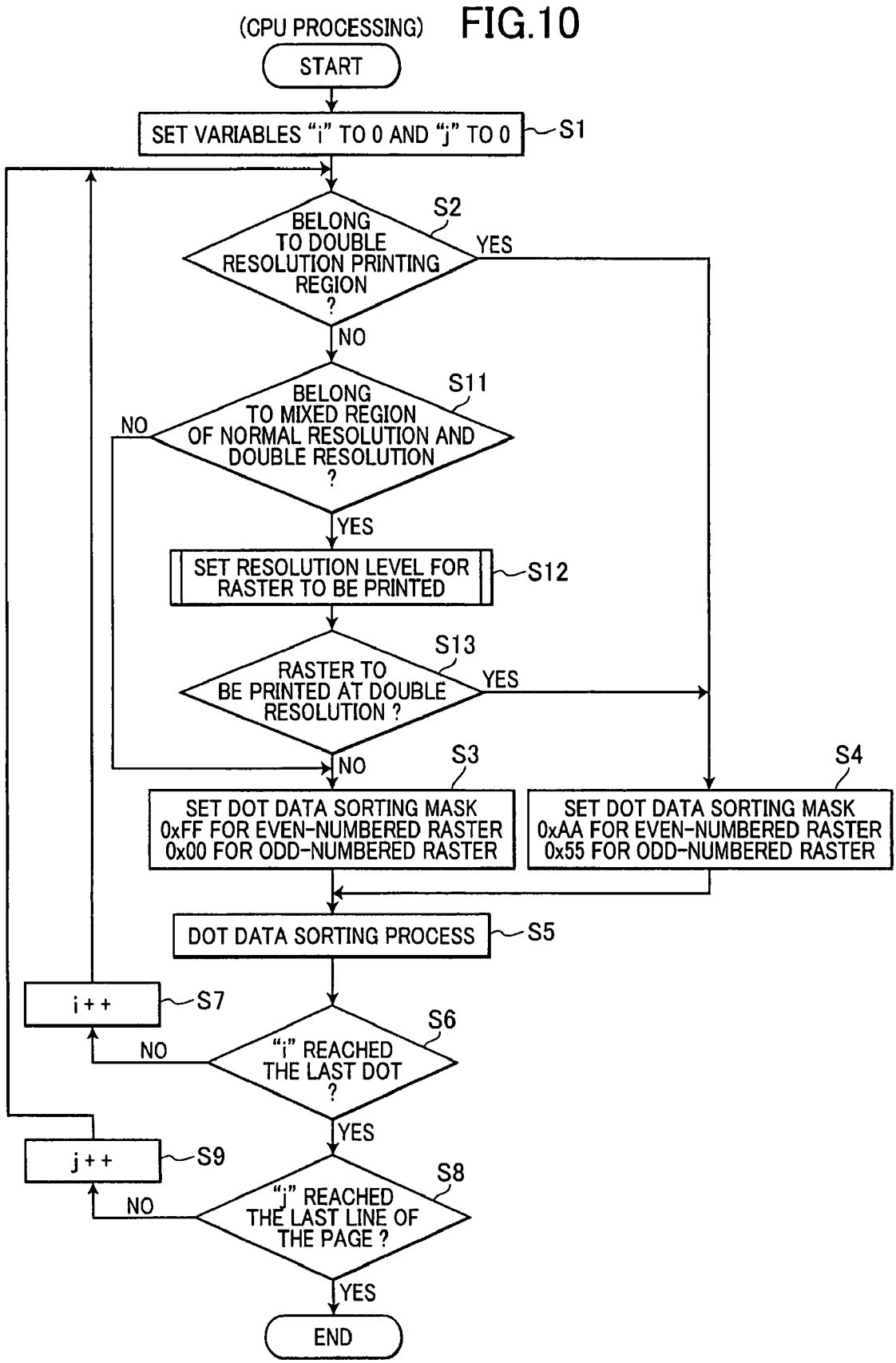
(CPU PROCESSING)
FIG.10
START
SET VARIABLES "i" TO 0 AND "j" TO 0
S1
BELONG TO DOUBLE RESOLUTION PRINTING REGION ?
S2
YES
NO
BELONG TO MIXED REGION OF NORMAL RESOLUTION AND DOUBLE RESOLUTION ?
S11
NO
YES
SET RESOLUTION LEVEL FOR RASTER TO BE PRINTED
S12
RASTER TO BE PRINTED AT DOUBLE RESOLUTION ?
S13
YES
NO
SET DOT DATA SORTING MASK 0xFF FOR EVEN-NUMBERED RASTER 0x00 FOR ODD-NUMBERED RASTER
S3
SET DOT DATA SORTING MASK 0xAA FOR EVEN-NUMBERED RASTER 0x55 FOR ODD-NUMBERED RASTER
S4
DOT DATA SORTING PROCESS
S5
i++
S7
"i" REACHED THE LAST DOT ?
S6
NO
YES
j++
S9
"j" REACHED THE LAST LINE OF THE PAGE ?
S8
NO
YES
END

IMAGE FORMING DEVICE

BACKGROUND OF THE INVENTION

1. Field of the Invention

The present invention relates to an image forming device, and more particularly to an image forming device which prevents a banding phenomenon caused by uneven feeding of a recording medium.

2. Description of Related Art

FIG. 1 is a side view showing a printer unit 1*a* included in a color inkjet printer as a conventional image forming device. The inkjet printer performs printing based on obtained data on a recording sheet using the printer unit 1*a*. The printer unit 1*a* includes a feed roller 101, a pinch roller 102, a discharge roller 103, spurs 104 and 105, a line feed motor (not shown) for rotating the rollers 101 and 103, a sheet sensor 106 for detecting the presence or absence of a recording sheet, a platen 108, and an inkjet head 109. In FIG. 1, a recording sheet led into the printer unit 1*a* is fed in a sheet feeding direction indicated by an arrow Z.

The inkjet head 109 is mounted in a carriage 64 to be described later (see FIG. 3) so as to move back and forth in a direction perpendicular to the sheet feeding direction Z (perpendicularly to the plane of FIG. 1). Ink cartridges (not shown) each filled with one of the following colors of ink, namely cyan, magenta, yellow, and black, supply the inkjet head 109 with the ink. The inkjet-head 109 ejects the supplied ink from any one of the large number of nozzles formed on the inkjet head 109 onto the recording sheet, thereby printing an image. The inkjet head 109 has a plurality of nozzles for each color, at regular intervals in substantially parallel with the sheet feeding direction. The platen 108 is opposed to the inkjet head 109. The recording sheet is fed between the platen 108 and the inkjet head 109.

In the printer unit 1*a*, the feed roller 101 is provided upstream of the inkjet head 109 in the sheet feeding direction. The feed roller 101 and the pinch roller 102 facing the feed roller 101 sandwich the recording sheet therebetween, and then send the recording sheet forward by the rotation of the rollers. Passing through the feed roller 101, the recording sheet is fed immediately below the inkjet head 109.

The discharge roller 103 is disposed downstream of the feed roller 101 and the inkjet head 109. The discharge roller 103 and the spur 104 facing the discharge roller 103 also sandwich the recording sheet therebetween, and then send the recording sheet forward. The spur 104 is a rotational body with an uneven surface. The spur 104, disposed above the discharge roller 103, comes into contact with an ink image on a printed surface of the recording sheet. Since the ink image does not get dry immediately after printed, if the ink image contacts a roller having a large contact area before the image get dry, the printed image may be blurred, crinkled, or transferred to the roller, thereby degrading printing quality. Therefore, the spurs are employed in this conventional image forming device so as to reduce the contact area that contacts the printed surface of the recording sheet, thereby preventing printing quality from degrading.

The feed roller 101 and the discharge roller 103 are driven by the line feed motor (not shown) as the drive source for transporting a recording sheet. This allows the feed roller 101 and the discharge roller 103 to rotate in the sheet feeding direction. The rollers 101 and 103, together with the roller 102 and the spur 104 facing the rollers 101 and 103 respectively, sandwich the recording sheet therebetween, and then send the recording sheet forward. Note that the discharge roller 103 rotates faster than the feed roller 101, while the feed roller 101 sandwiches the recording sheet stronger than the discharge roller 103. Thus, the recording sheet disposed on the region opposing the inkjet head 109 is tautened, thereby preventing printing quality from degrading.

Therefore, while the recording sheet is being sandwiched by the feed roller 101 and the pinch roller 102, specifically until a trailing edge of the recording sheet passes through the nip between the feed roller 101 and the pinch roller 102, the feed roller 101 continues to send the recording sheet forward.

On the other hand, after the trailing edge of the recording sheet has passed through the nip between the feed roller 101 and the pinch roller 102, the recording sheet is fed by the rotation of the discharge roller 103.

While the recording sheet is fed by the feed roller 101 and the pinch roller 102 sandwiching the recording sheet, the sheet feeding accuracy is maintained. However, when the recording sheet reaches a point where the recording sheet leaves the feed roller 101 and the pinch roller 102, the trailing edge of the recording sheet is released from the pressure which has been applied on. This means that the sheet feeding accuracy becomes unstable due to the sheet being flipped, thereby causing a banding phenomenon.

Japanese Patent Application Laid-Open Publication No. 11-207945 and Japanese Patent Application Laid-Open Publication No. 11-291506 propose increasing a resolution level in the region where a banding phenomenon occurs so as to prevent the banding phenomenon. Japanese Patent Application Laid-Open Publication No. 2005-138501 discloses the method of decreasing the feeding amount of a recording medium to prevent the occurrence of a banding phenomenon.

However, although a banding phenomenon is prevented to some extent by these inventions, its banding pattern is still recognizable.

FIGS. 2A and 2B simulate how a banding phenomenon occurs. In these figures, each circle represents a dot formed with ink. FIG. 2A shows a case in which printing is performed while a recording sheet is fed by the feed roller 101 and the pinch roller 102 sandwiching the sheet. The dots are arranged systematically in a grid pattern. The expression "normal arrangement" in FIG. 2 means that a raster line is formed with dots aligned in a direction perpendicular (orthogonal) to the sheet feeding direction (Z direction in the figure), and one raster line is disposed on another raster line in sequence in the feeding direction.

FIG. 2B shows a case in which printing is performed in normal arrangement when a recording sheet is sent forward suddenly to an extreme degree. In this case, a linear space appears as indicated by two parallel solid lines in a direction perpendicular to the sheet feeding direction. This phenomenon causes a white line to be recognizable in a direction perpendicular to the sheet feeding direction.

SUMMARY OF THE INVENTION

In view of the above-described drawbacks, it is an objective of the present invention to provide an image forming device that prevents a banding phenomenon with a simple structure.

In order to attain the above and other objects, the present invention provides an image forming device including a feeding unit, a recording unit, and a controller. The feeding unit includes a first feeding member and a second feeding member disposed at a downstream of the first feeding member in a feeding direction. At least one of the first feeding member and the second feeding member feeds a recording medium in the feeding direction. The recording unit is disposed between the first feeding member and the second feeding member to eject a plurality of ink droplets onto the recording medium fed between the first feeding member and the second feeding member. A plurality of ink droplets ejected onto the recording medium forms a plurality of raster lines extending in a main-scanning direction orthogonal to the feeding direction. The controller controls the recording unit to eject a plurality of ink droplets so that a plurality of first raster lines formed within a first time span has a first resolution in the feeding direction, a plurality of second raster lines formed within a second time span has a second resolution in the feeding direction, and a plurality of third raster lines formed within a third time span including a banding timing at which a trailing edge of the recording medium gets away from the first feeding member has a third resolution higher than the first resolution in the feeding direction. The second time span follows the first time span and the third time span follows the second time span. The second resolution is higher than the first resolution and lower than the third resolution.

Another aspect of the present invention provides an image forming device including a feeding unit, a recording unit, and a controller. The feeding unit includes a first feeding member and a second feeding member disposed at a downstream of the first feeding member in a feeding direction. At least one of the first feeding member and the second feeding member feeds a recording medium in the feeding direction. The recording unit is disposed between the first feeding member and the second feeding member to eject a plurality of ink droplets onto the recording medium fed between the first feeding member and the second feeding member. A plurality of ink droplets ejected onto the recording medium forms a plurality of raster lines extending in a main-scanning direction orthogonal to the feeding direction. The controller controls the recording unit to eject a plurality of ink droplets so that a plurality of first lines formed within a first time span has a first resolution in the feeding direction, and a plurality of second raster lines formed within a second time span including a banding timing at which a trailing edge of the recording medium gets away from feeding by the first feeding member has a second resolution higher than the first resolution in the feeding direction. The second time span follows the first time span. The plurality of ink droplets ejected in the second time span forms a plurality of dots on the recording medium to be in a staggered pattern.

Another aspect of the present invention provides an image forming device including a feeding unit, a recording unit, and, a controller. The feeding unit includes a first feeding member and a second feeding member disposed at a downstream of the first feeding member in a feeding direction. At least one of the first feeding member and the second feeding member feeds a recording medium in the feeding direction. The recording unit is disposed between the first feeding member and the second feeding member to eject a plurality of ink droplets onto the recording medium fed between the first feeding member and the second feeding member. A plurality of ink droplets ejected onto the recording medium forms a plurality of raster lines extending in a main-scanning direction orthogonal to the feeding direction. The recording medium includes a first region, a second region adjacent to the first region in the feeding direction, and a third region adjacent to the second region in the feeding direction without being adjacent to the first region. The third region has a banding region on which the recording unit records the plurality of ink droplets when a trailing edge of the recording medium gets away from the first feeding member. The controller controls the recording unit to eject a plurality of ink droplets so that a plurality of first raster lines formed on the first region has a first resolution in the feeding direction. A plurality of second raster lines formed on the second region has a second resolution in the feeding direction, and a plurality of third raster lines formed on the third region has a third resolution higher than the first resolution in the feeding direction. The second resolution is higher than the first resolution and lower than the third resolution.

Another aspect of the present invention provides an image forming device including a feeding unit, a recording unit, and a controller. The feeding unit includes a first feeding member and a second feeding member disposed at a downstream of the first feeding member in a feeding direction. At least one of the first feeding member and the second feeding member feeds a recording medium in the feeding direction. The recording unit is disposed between the first feeding member and the second feeding member to eject a plurality of ink droplets onto the recording medium fed between the first feeding member and the second feeding member. A plurality of ink droplets ejected onto the recording medium forms a plurality of raster lines extending in a main-scanning direction orthogonal to the feeding direction. The recording medium includes a first region, and a second region adjacent to the first region in the feeding direction. The second region has a banding region on which the recording unit records the ink droplets when a trailing edge of the recording medium gets away from the first feeding member. The controller controls the recording unit to eject a plurality of ink droplets so that a plurality of first raster lines formed on the first region has a first resolution in the feeding direction, and a plurality of second raster lines formed on the second region has a second resolution higher than the first resolution. The plurality of ink droplets ejected on the second region forms a plurality of dots on the recording medium to be in a staggered pattern.

BRIEF DESCRIPTION OF THE DRAWINGS

The above and other objects, features and advantages of the invention will become more apparent from reading the following description of the preferred embodiments taken in connection with the accompanying drawings in which:

FIG. 10 is a flow chart showing a dot sorting process according to the second embodiment.

DETAILED DESCRIPTION OF THE PREFERRED EMBODIMENTS

Figure 1:
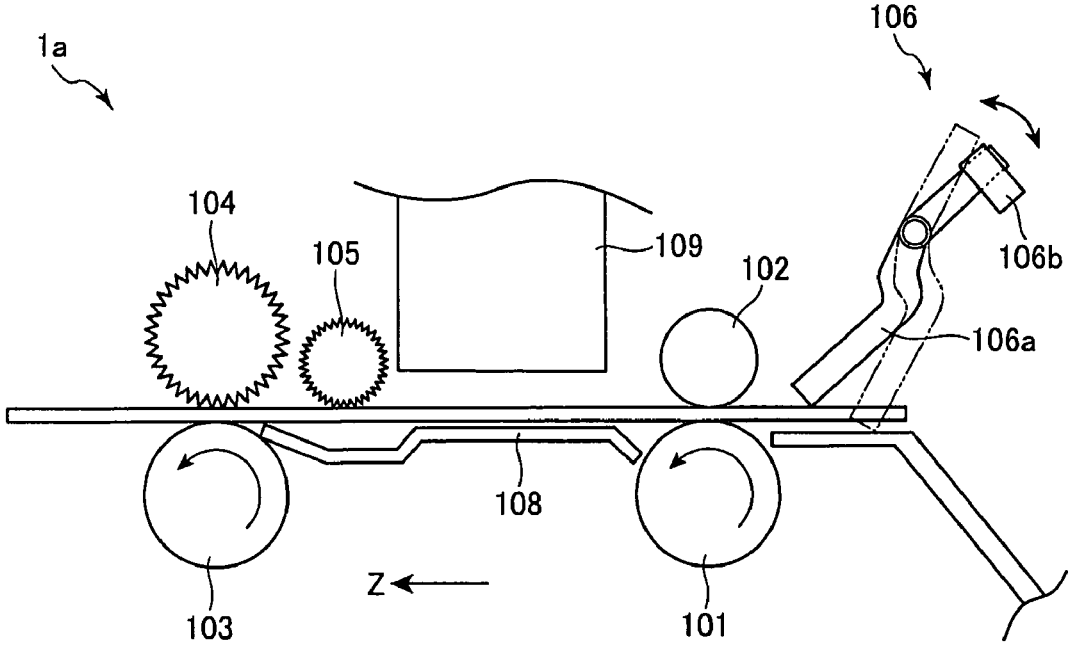
FIG. 1 is a side view of a conventional printer unit.

An image forming device according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts when the image forming device is disposed in an orientation in which it is intended to be used.

Figure 3:
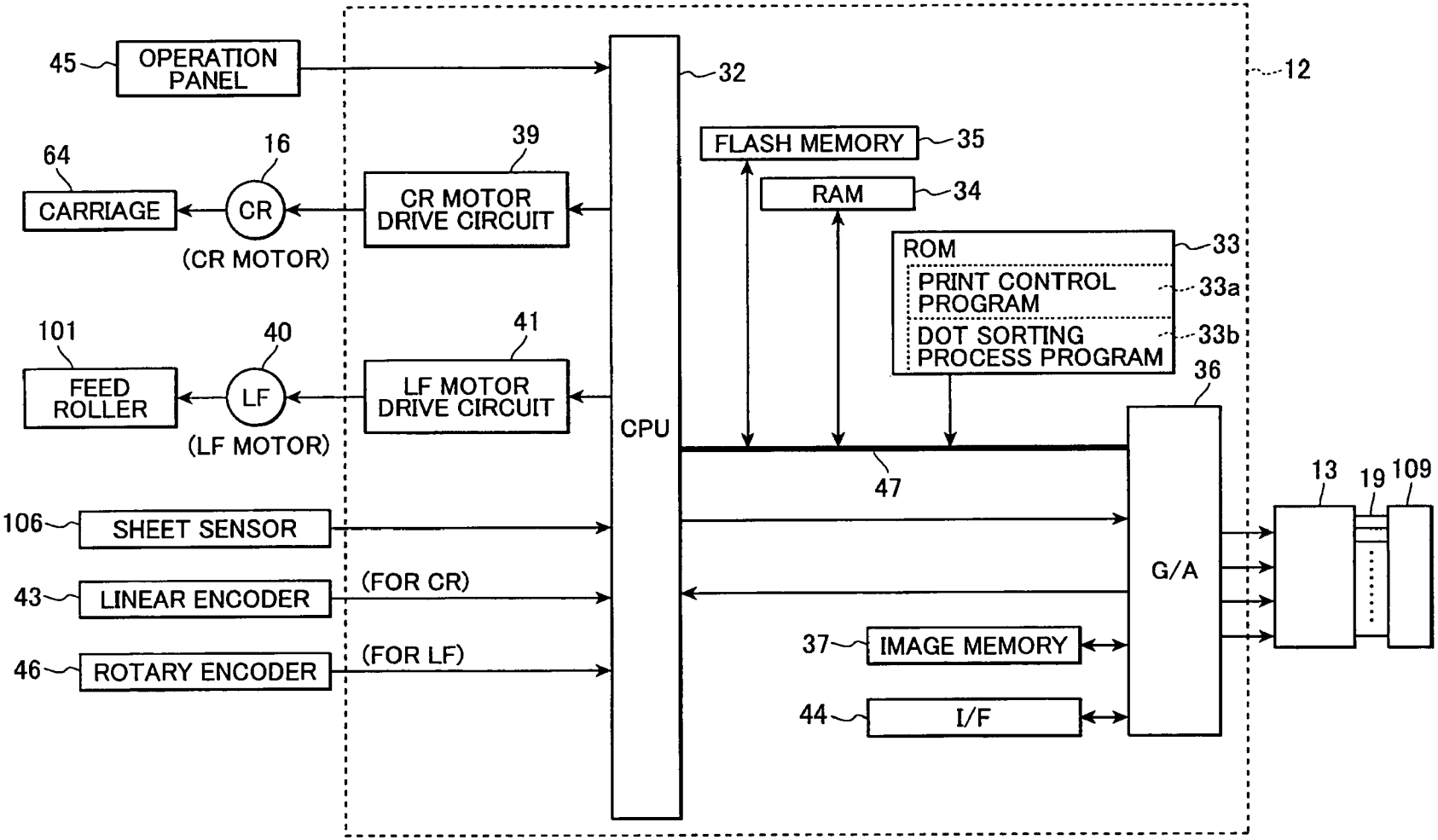
FIG. 3 is a block diagram showing the electric circuitry of a color inkjet printer including an image forming device according to a first embodiment of the present invention.

Hereinafter, a first preferred embodiment of a color inkjet printer 1 according to the present invention will be described with reference to the accompanying drawings. FIG. 3 is a block diagram showing the electric circuitry of the color inkjet printer 1 briefly. The mechanism of a printer unit 1*a* as a main unit for printing is the same as shown in FIG. 1.

A controller for controlling the color inkjet printer 1 is provided with a printer control circuit board 12 and a carriage board 13. The printer control circuit board 12 includes a one-chip microcomputer (CPU) 32; a ROM 33 which stores various control programs to be run by the CPU 32 and fixed value data; a RAM 34 as a memory for storing various types of data temporarily; a flash memory 35; an image memory 37; and a gate array (G/A) 36.

The CPU 32, which is a processor, generates a printing timing signal and a reset signal according to the control program pre-stored in the ROM 33, and then transfers each of the signals to the gate array 36 (to be described later). The following devices are connected to the CPU 32: an operation panel 45 which a user gives a direction for printing; a CR motor drive circuit 39 for driving a carriage motor (CR motor) 16 which operates a carriage 64 having an inkjet head 109; a LF motor drive circuit 41 which operates a line feed motor (LF motor) 40 for driving a feed roller 101; a sheet sensor 106; a linear encoder 43; and a rotary encoder 46. These devices are controlled by the CPU 32.

The sheet sensor 106, which is disposed upstream of the feed roller 101, detects the presence or absence of a recording sheet. The sheet sensor 106 includes a lever 106*a* which turns around as comes into contact with a recording sheet (see FIG. 1); and a photointerrupter 106*b* as a sensor unit which detects the lever 106*a* turning around (see FIG. 1). The linear encoder 43 detects the moving amount of the carriage 64. The amount encoded by the linear encoder 43 is detected by the photointerrupter (not shown) so that the reciprocating motion of the carriage 64 is controlled. The rotary encoder 46 detects the rotation amount of the feed roller 101. The amount encoded by the rotary encoder 46 is detected by the photointerrupter (not shown) so that the feed roller 101 is controlled. Specifically, the rotary encoder 46 detects the actual position of the recording sheet fed by the feed roller 101 with a predetermined accuracy.

The ROM 33 stores a print control program 33*a* for performing printing and a dot sorting process program 33*b* for arranging dot positions so as to prevent the occurrence of a banding phenomenon. The flash memory 35 has to store correction values for feeding a recording sheet accurately and for allowing the head to scan accurately. The flash memory 35 is reviewed for the values before its shipment. The CPU 32, the ROM 33, the RAM 34, the flash memory 35 and the G/A 36 are connected through a bus line 47.

The G/A 36 outputs recording data (drive signal) for recording the image data stored in the image memory 37 on a recording sheet, based on the timing signal transferred from the CPU 32 and the image data; a transfer clock synchronizing to the recording data; a latch signal; a parameter signal for generating a basic drive waveform signal; and a discharging timing signal to be output cyclically. The signals each are transferred by the G/A 36 to the carriage board 13 including a head driver.

The image data transferred from an external device such as a computer through an interface (I/F) 44 such as a USB interface is stored in the image memory 37 by the G/A 36. The G/A 36 then generates a data reception interruption signal based on the data transferred from the computer or the like through the I/F 44, and transfers the signal to the CPU 32. The signals to be exchanged between the G/A 36 and the carriage board 13 are transferred through a harness cable connecting them.

The head driver (drive circuit) mounted on the carriage board 13 drives the inkjet head 109. The inkjet head 109 and the head driver are connected to each other by a flexible wiring board 19 on which a copper-foiled wiring pattern is formed on a polyimide film having a thickness of 50 to 150 μm. The head driver is controlled via the G/A 36 mounted on the printer control circuit board 12, and applies a drive pulse signal having a waveform corresponding to a recording mode to a piezoelectric actuator included in the inkjet head 109 so that a predetermined amount of ink is ejected from the inkjet head 109.

Figure 2A:
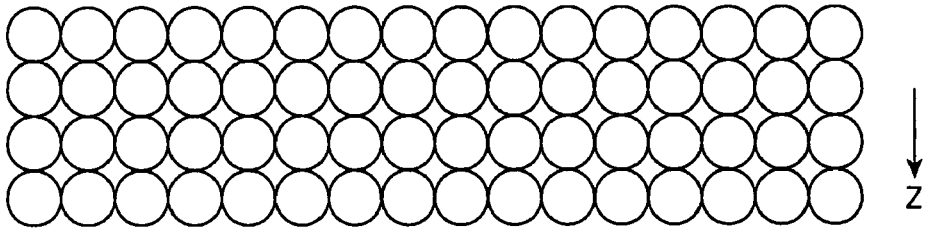
FIG. 2A is a schematic diagram showing a conventional dot arrangement printed properly.
Figure 2B:
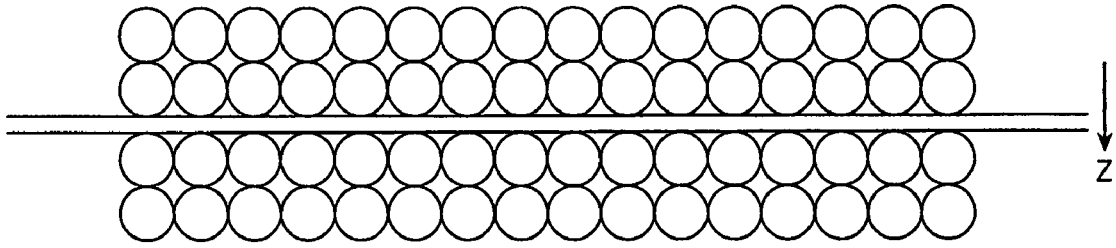
FIG. 2B is a schematic diagram showing a conventional dot arrangement printed when a skip occurs during the sheet feeding process.
Figure 4A:
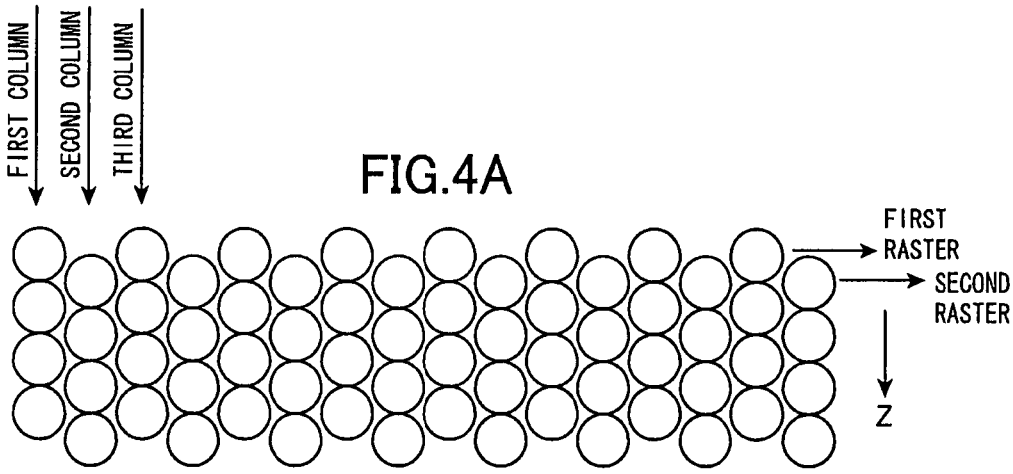
FIG. 4A is a schematic diagram showing an arrangement of dots formed on a recording sheet properly.
Figure 4B:
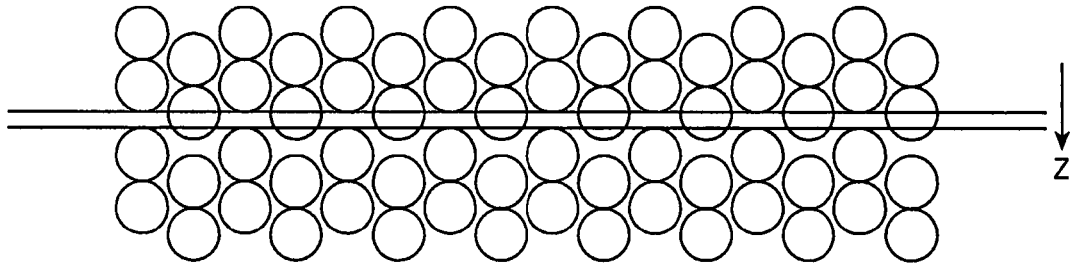
FIG. 4B is a schematic diagram showing an arrangement of dots formed on a recording sheet when a skip occurs during the sheet feeding process.

Referring to FIGS. 4A and 4B, a description is given for the arrangement of dots formed on a recording sheet by the color inkjet printer 1 according to the first embodiment. FIGS. 4A and 4B simulate the arrangement of dots formed on a recording sheet when forming an image at a resolution higher than normal value. Similarly to FIG. 2 showing the conventional dot arrangement, each circle represents a dot formed with ink, and a sheet feeding direction is indicated by an arrow Z.

In the present embodiment, as shown in FIG. 4A, the one dot and one space are aligned alternately in a direction perpendicular to the sheet feeding direction Z to form dot lines (raster line). Each dot forming first raster line is formed at the position corresponding to each space in the adjacent second raster line, and the first raster line is disposed away from the second raster line at a distance equal to the half width of the raster line in the feeding direction Z. In other words, the dots forming first column are arranged at the positions deviated from the dots forming the adjacent second column, in the feeding direction Z. FIG. 4A shows a case in which a recording sheet is fed properly. Specifically, printing is performed while a recording sheet is fed by the feed roller 101 and the pinch roller 102 sandwiching the sheet. In this case, dots are arranged in a staggered layout with regularity.

FIG. 4B shows a staggered arrangement formed when a recording sheet is fed unevenly and sent forward suddenly to an extreme degree (a skip occurs during the sheet feeding process). In FIG. 4B, two parallel solid lines are indicated virtually at the position of the linear space shown in FIG. 2B. As shown in FIG. 4B, the space does not appear linear when dots are formed at a staggered arrangement. Therefore, the dots thus arranged can prevent the occurrence of a banding phenomenon.

Since the dots are arranged in the so-called staggered layout in the present embodiment, as shown in FIG. 4B, even when a skip occurs during the sheet feeding process, the basic color of the unprinted portion of a recording sheet is not exposed in a straight line, but discretely. Thus, the banding pattern due to the skip becomes invisible.

In FIGS. 4A and 4B, the dots forming the first column are arranged at the positions deviated from the dots forming the adjacent second column in the feeding direction Z, and the dots forming the second column are arranged at the positions deviated from the dots forming adjacent third column. However, the dots forming the first column and the second column may not be deviated from each other in the feeding direction Z, while being deviated from the dots forming the third column in the feeding direction Z. Further, the dots forming the first column, the second column and the third column may not be deviated from each other in the feeding direction Z, while being deviated from the dots forming a fourth column adjacent to the third column. In short, one raster line is segmented into a plurality of sub-lines, and the segmented sub-lines are arranged so as to deviate from each other in their feeding directions. This prevents the occurrence of a banding phenomenon.

Figure 5A:
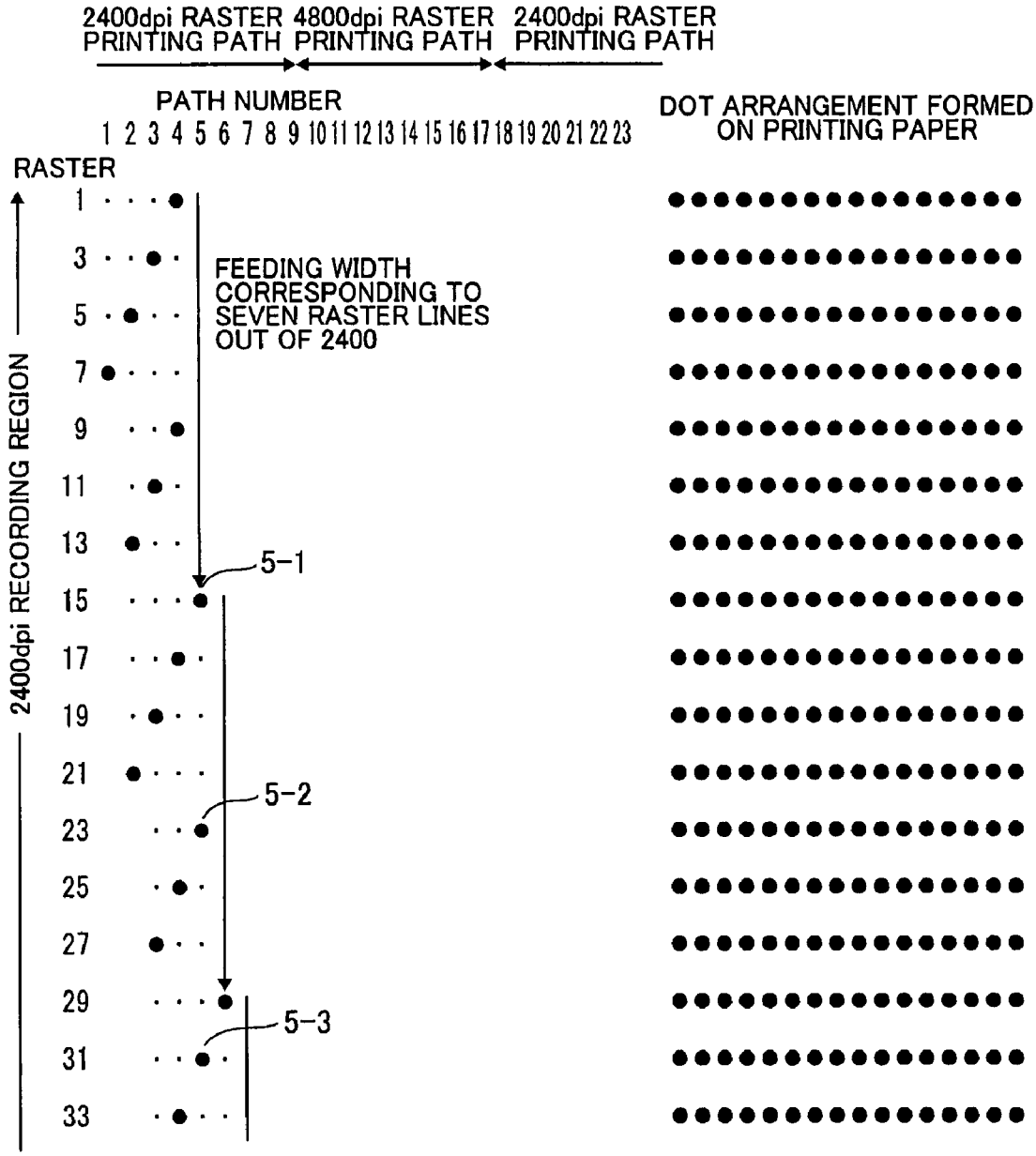
FIG. 5A illustrates a method of sorting dots formed in the interlace system according to the first embodiment.

Next, referring to FIGS. 5A to 6B, a description is given for the method of sorting dots formed in the interlace system. FIGS. 5A to 6B show the following regions corresponding to the progress of raster processing: the region where dots are formed at a print resolution of 2400 dpi, and the region dots are formed at a print resolution of 4800 dpi. Dots are formed in sequence in the interlace system. Raster 33 as the last line shown in FIG. 5A is followed by raster 35 as the first line in FIG. 5B. Raster 65 as the last line shown in FIG. 5B is followed by raster 67 as the first line shown in FIG. 6A. Raster line 103 as the last line shown in FIG. 6A is followed by raster 104 shown in FIG. 6B. The "raster number" means a line number assigned to each raster line as the dot line which is formed by the head moving in a main scanning direction, from the top toward the bottom of a recording sheet. In these figures, the description for the leading edge of a recording sheet is omitted, and a raster line around its middle portion is shown as raster 1.

The "path number" (path No.) provided above raster 1 in FIG. 5A is the order of the raster scanned by the head 109. A black circle is given at the point of intersection of a given path number and a given raster line, which means a dot is formed by the path. If no dot is formed, a small point is given instead of the black circle.

Figure 5B:
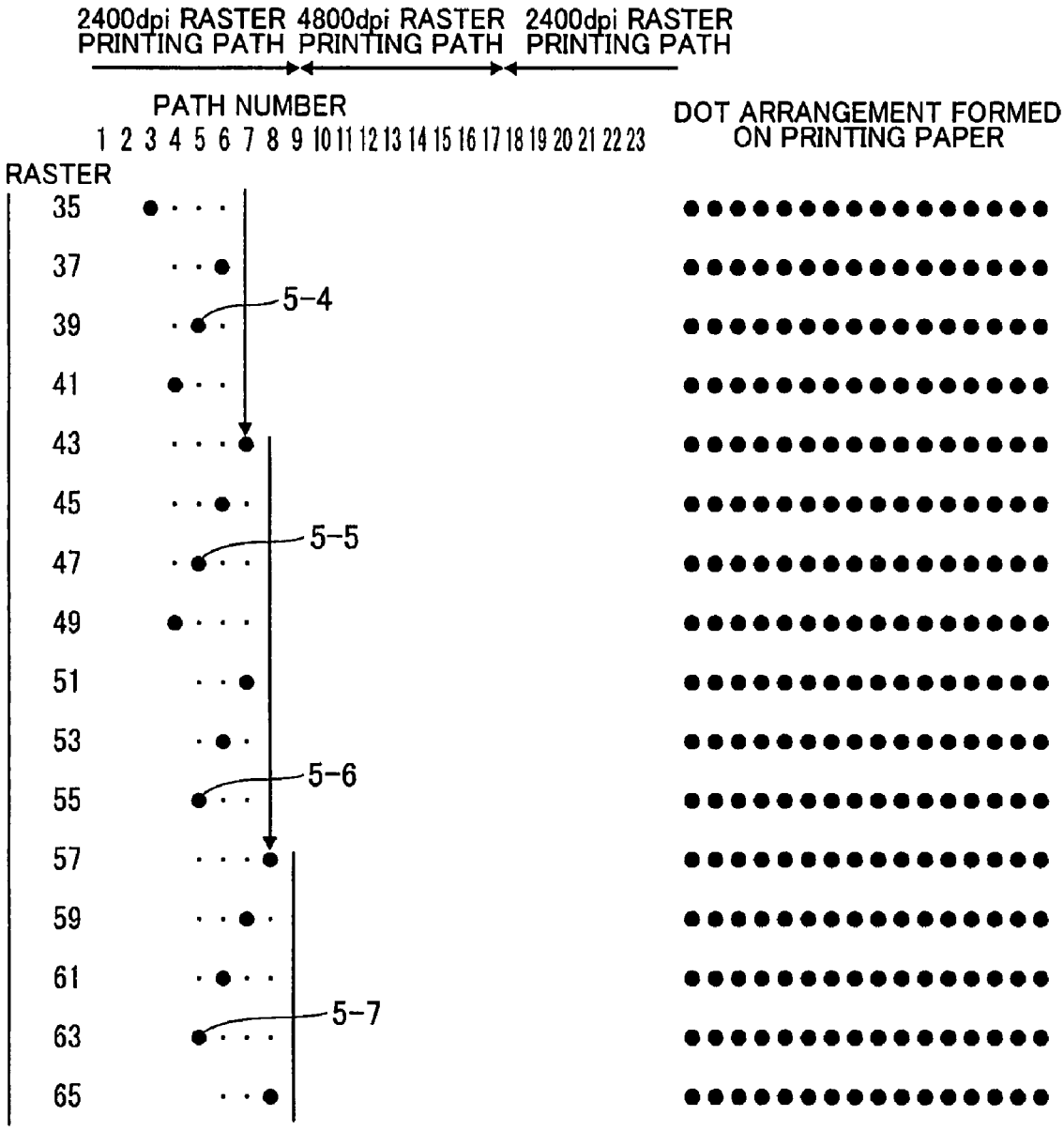
FIG. 5B illustrates the dot storing method as a sequel to FIG. 5A.

Referring to FIGS. 5A and 5B, for example, in path 5, the following seven raster lines are formed at the same time: raster 15 shown as a black circle of 5-1; raster 23 as a black circle of 5-2; raster 31 as a black circle of 5-3; raster 39 as a black circle of 5-4; raster 47 as a black circle of 5-5; raster 55 as a black circle of 5-6; and raster 63 as a black circle of 5-7. Similarly, in path 6, raster lines 29, 37, 45, 53, 61, 69, and 77 are formed (see FIG. 6A).

In the present embodiment, the head 109 is provided with 49 nozzles in the feeding direction Z. As indicated by a downward arrow, as one or more raster has been formed in one path, the recording sheet is fed in the opposite direction of the arrow by a width corresponding to seven raster lines. The recording sheet is thus feed by degrees, thereby forming each dot.

In the region at a resolution level of 2400 dpi, only raster lines having an odd number are formed. On the right side of FIGS. 5A to 6B, there is shown the arrangement of the dots formed on the recording sheet corresponding to the raster lines.

Figure 6A:
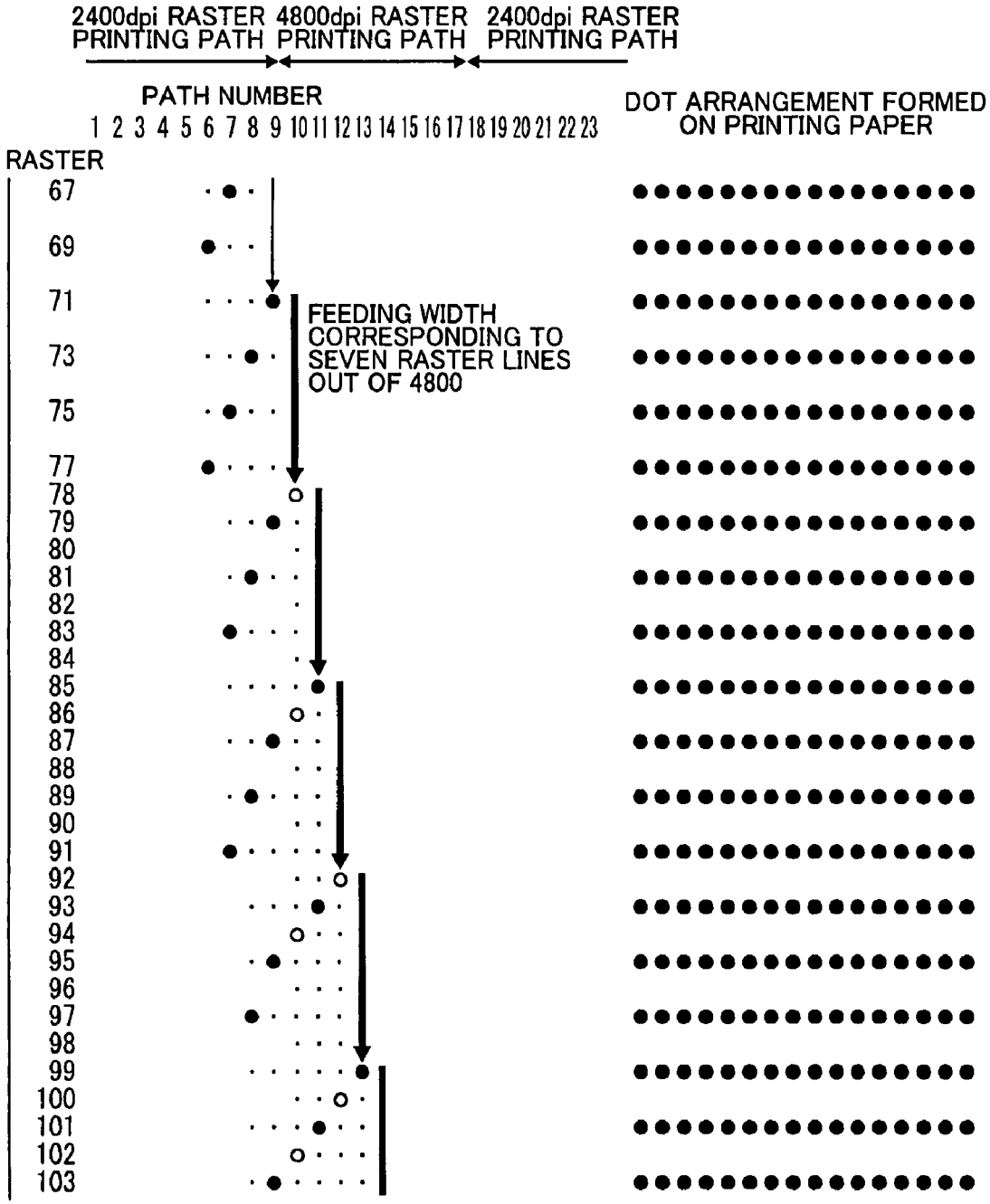
FIG. 6A illustrates the dot sorting method as a sequel to FIG. 5B.
Figure 6B:
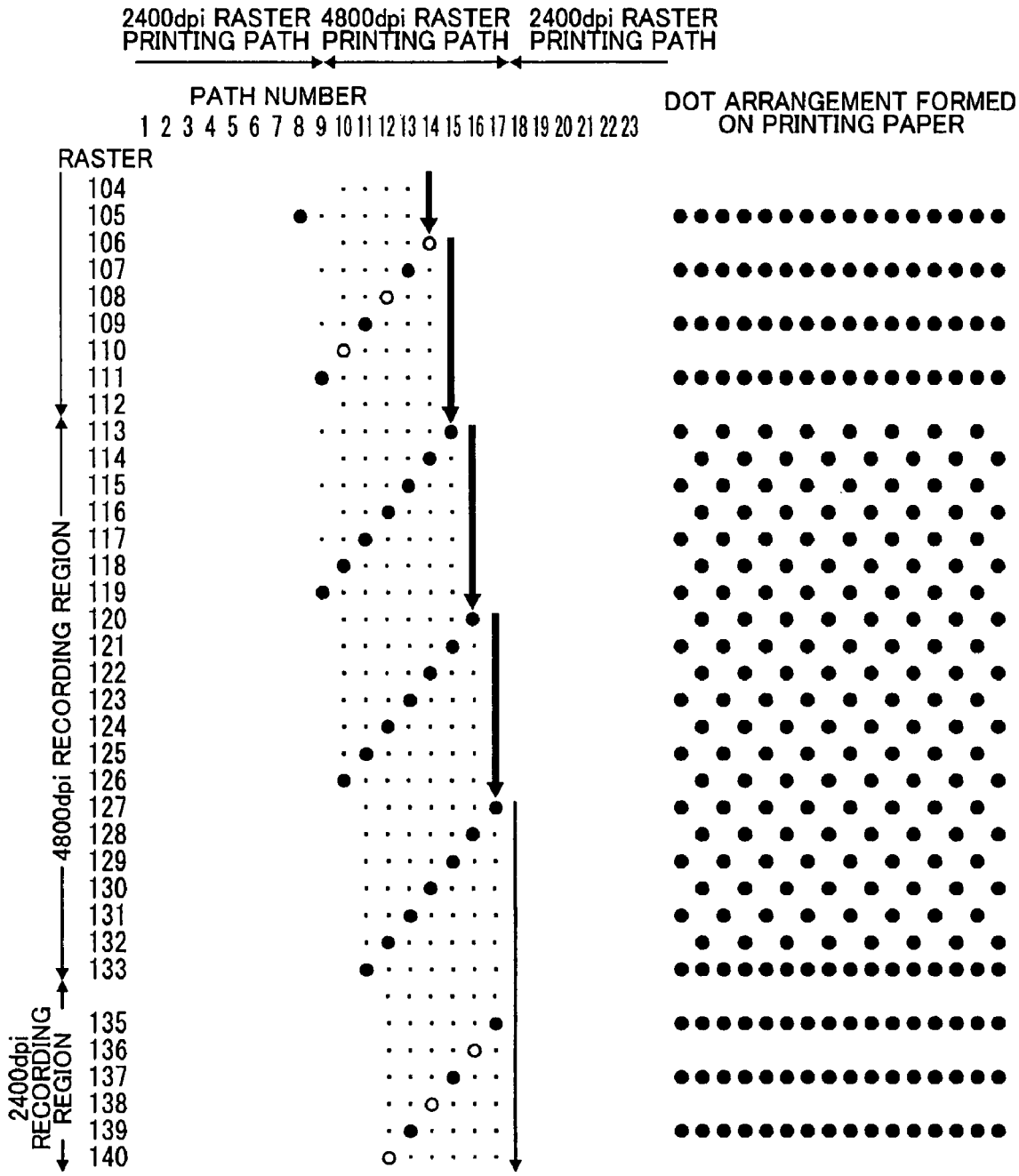
FIG. 6B illustrates the dot sorting method as a sequel to FIG. 6A.

As shown in FIGS. 6A and 6B, in the range from raster 113 to 132, resolution is set at a level of 4800 dpi, and dots are arranged in a staggered layout. Since a skip occurs while printing is performed in this section, the resolution is increased only within the section, and its dot arrangement is changed. As has been described above, since dots are arranged in a staggered layout, even when a skip occurs during the sheet feeding process, a banding phenomenon is prevented from occurring on an image to be formed.

The path range where printing is performed with this staggered-arranged region is from path 9 to path 17. Within the path range, the width of the recording sheet to be fed is reduced to half compared to the width for a resolution level of 2400 dpi; the resolution is set at a value of 4800 dpi; a raster line having an even number is formed in an even-numbered path; and a raster line having an odd number is formed in an odd-numbered path. For example, dots are formed along raster 118 and raster 126 for path 10 while dots are formed along raster 117, raster 125, and raster 133 for path 11. The dots formed along an even-numbered raster line are arranged to deviate from the dots formed along an odd-numbered raster line in the feeding direction.

In the region coming after the staggered-arranged region, the resolution returns to a level of 2400 dpi so as to form a raster line.

Figure 7:
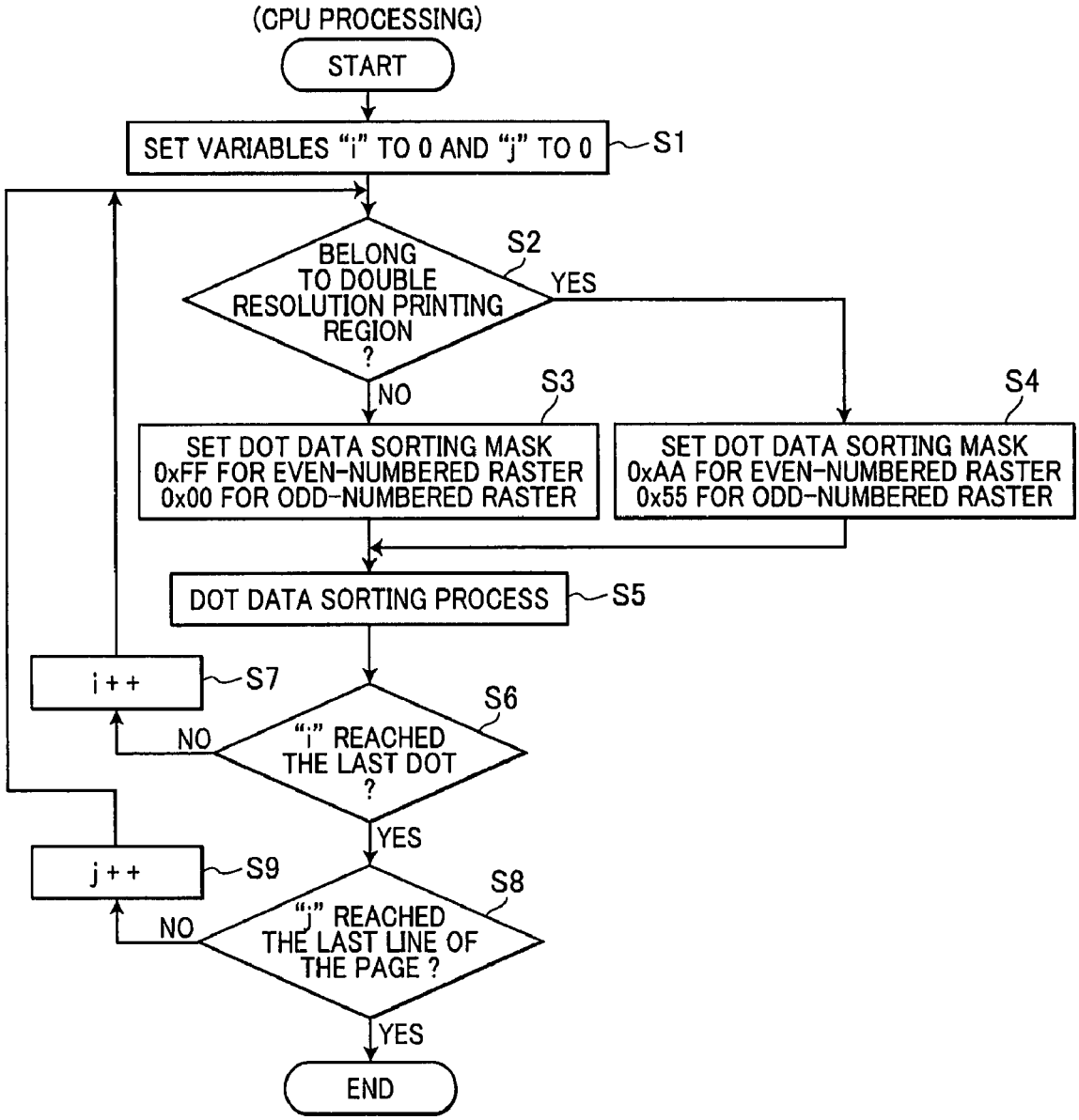
FIG. 7 is flow chart showing a dot sorting process according to the first embodiment.

Next, referring to FIG. 7, a description is given for the process performed by the dot sorting process program 33*b* run by the CPU 32. FIG. 7 is a flow chart showing the process performed by the dot sorting process program 33*b*. In the dot sorting process, print data is input based on the assumption that printing is performed at a resolution level of 2400 dpi. For a region where the print data is to be printed at double resolution, a conversion is performed so that dots are arranged in a staggered layout. Since this process is required for each recording sheet, the process has to be repeated a plural number of times in order to perform printing on a plurality of recording sheets.

First, the variable "i" representing a dot position for forming a raster line (dot order in the main scanning direction) is set to a value of "0", and the variable "j" representing the raster order in the feeding direction is set to a value of "0" (S1). Next, the input print data is obtained in sequence 8 bit by 8 bit, and a determination is made whether or not the raster having the 8 bit data belongs to the region where printing is performed at double resolution (S2). In this embodiment, the information indicating that a record is to be produced at double resolution from which raster to which raster is prestored in the ROM 33, and a determination is made whether or not the obtained data is recorded at double resolution based on the stored information.

If the print data is to be recorded not at double resolution but at normal resolution (S2: No), the mask for the even-numbered raster is set to the hexadecimal number "FF" (the symbol "0x" attached in front of the number in the flowchart indicates that the number is represented in hexadecimal format), and the mask for the odd-numbered raster is set to the hexadecimal number "00" (S3). Therefore, sorting is performed in the following manner. For the even-numbered raster, dots are formed on both the even-numbered and odd-numbered columns. For the odd-numbered raster, dots are formed on neither the even-numbered and odd-numbered columns. Note that even numbers and odd numbers assigned to the raster in FIGS. 5A to 6B are opposite to even numbers and odd numbers assigned to raster in FIG. 7.

On the other hand, if the print data is to be recorded at double resolution (S2: Yes), the mask for the even-numbered raster is set to the hexadecimal number "AA", and the mask for the odd-numbered raster is set to the hexadecimal number "55" (S4). Therefore, sorting is performed in the following manner. For the even-numbered raster, dots are formed on the even-numbered columns while no dots are formed on the odd-numbered columns. For the odd-numbered raster, no dots are formed on even-numbered columns while dots are formed on the odd-numbered columns.

When Step S3 or S4 is finished, the print data is multiplied by the set mask that is hexadecimal number, and the multiplied print data is stored in the image memory 37 (S5). Next, a determination is made whether or not the value "i" has reached the value indicating that conversion has been performed up to the last dot of the raster (S6). If not reached yet (S6: No), the value "i" is incremented (S7), and the process returns to Step S2 so that conversion is performed by obtaining the value of the next 8 bit composing a raster. If the value "i" has reached the value indicating that conversion has been performed up to the last dot of the raster (S6: Yes), a determination is made whether or not the raster variable "j" is equal to the value indicating the last raster of a page (S8). If the variable "j" is not equal to the value indicating the last raster (S8: No), the variable "j" is incremented (S9), and the process returns to Step S2 so that conversion is performed for the next raster. If the raster variable "j" is equal to the value indicating the last raster (S8: Yes), which means that the all the steps in raster processing for this page has been finished, the dot sorting process has been completed.

As has been described above in the first embodiment, in the printing region where a skip occurs during the sheet feeding process, resolution is set at a higher value, and its dot arrangement is changed into a staggered layout. This prevents the occurrence of a banding phenomenon such as the appearance of a linear space in spite of the skip occurrence, thereby achieving high quality printing. Further, in a region where no banding phenomenon occurs, it is possible to decrease its resolution while maintaining image quality, and to increase an image forming speed. Even if the discharge roller 103 rotates faster than the feed roller 101 while the feed roller 101 sandwiches the recording sheet stronger than the discharge roller 103, such as the present embodiment, the occurrence of a banding phenomenon is prevented.

Figure 8A:
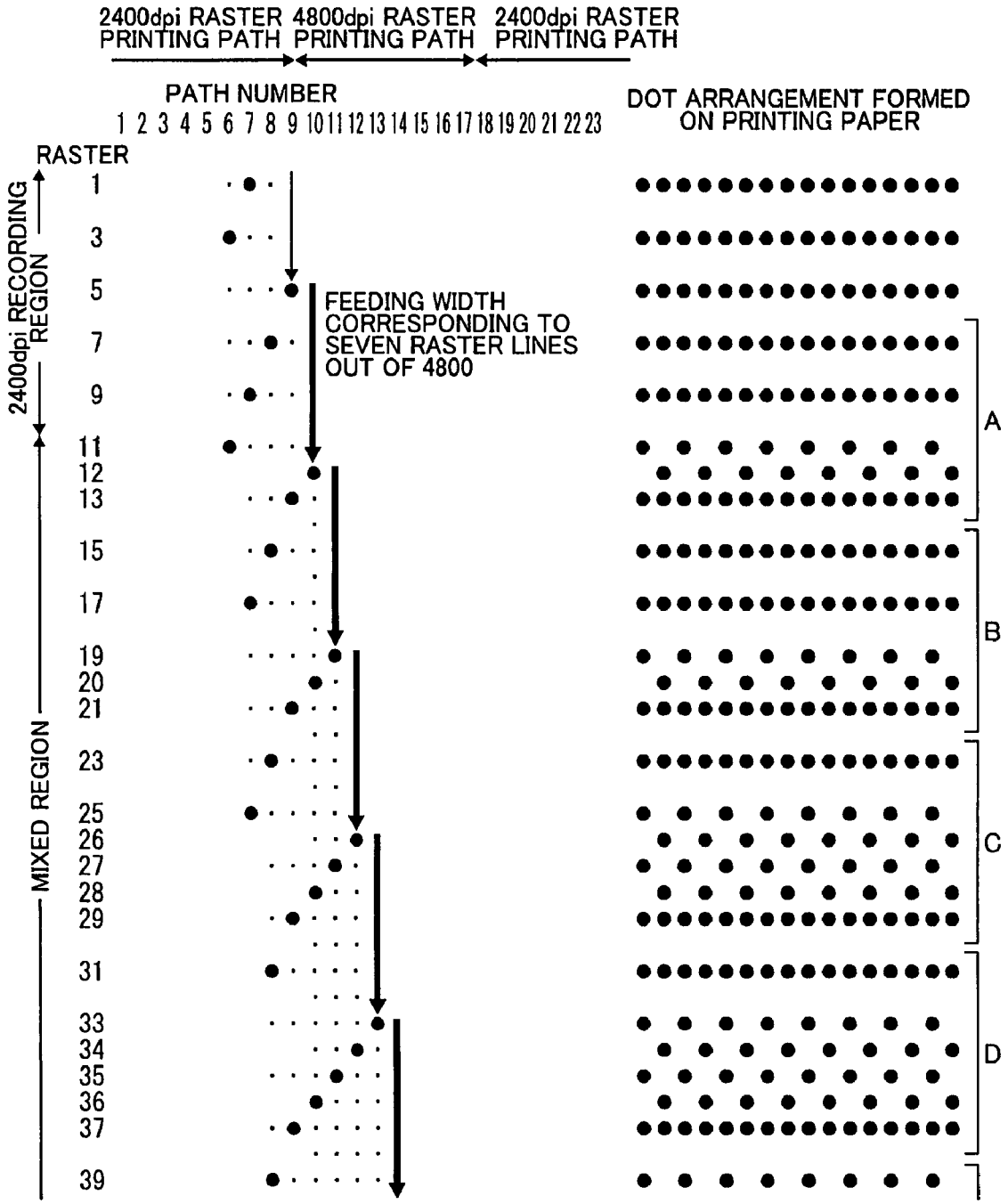
FIG. 8A illustrates a dot sorting method according to a second embodiment.

Next, a description is given for a second embodiment. In the first embodiment, printing is performed at a higher resolution with dots arranged in a staggered layout in the printing region where a skip occurs during the sheet feeding process. However, since resolution changes drastically, that is, color changes in a direction perpendicular to the feeding direction, a slight line may appear around the boundary between the two regions. In the second embodiment, in order to prevent the appearance of such a line, resolution is changed gradually. Specifically, in the region being transition from the normal region to the region with a higher resolution, dots are formed with resolution increasing gradually. In the region being in transition from the region with the higher resolution to the normal region, dots are formed with resolution decreasing gradually. In the region where the resolution increases, dots are arranged in a staggered layout. Referring to FIGS. 8A to 9, the above situation will be described. In the second embodiment, the description for the structural points which are the same as in the first embodiment is omitted. Only different points are described here.

Figure 8B:
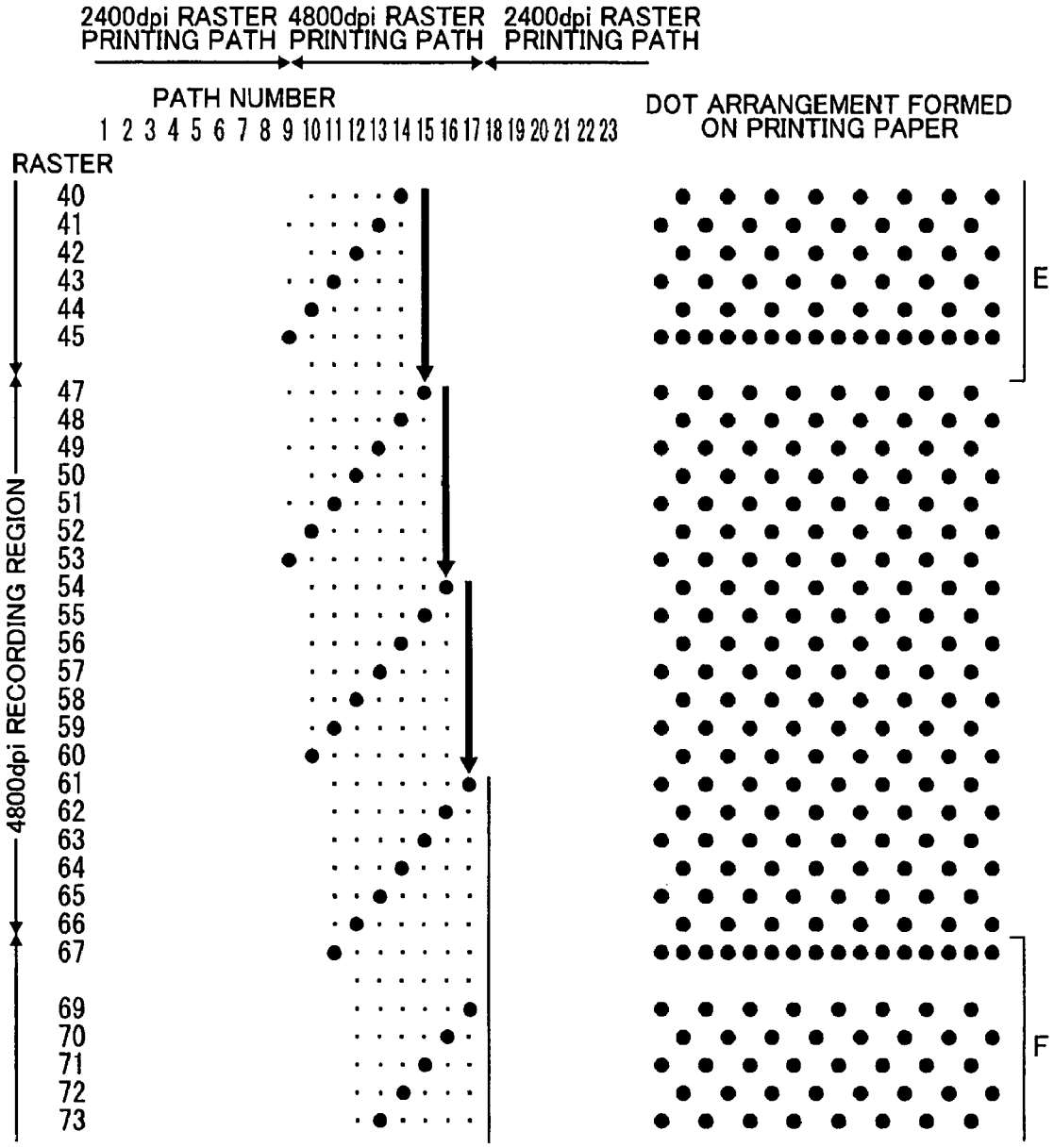
FIG. 8B illustrates the dot sorting method as a sequel to FIG. 8A.
Figure 9:
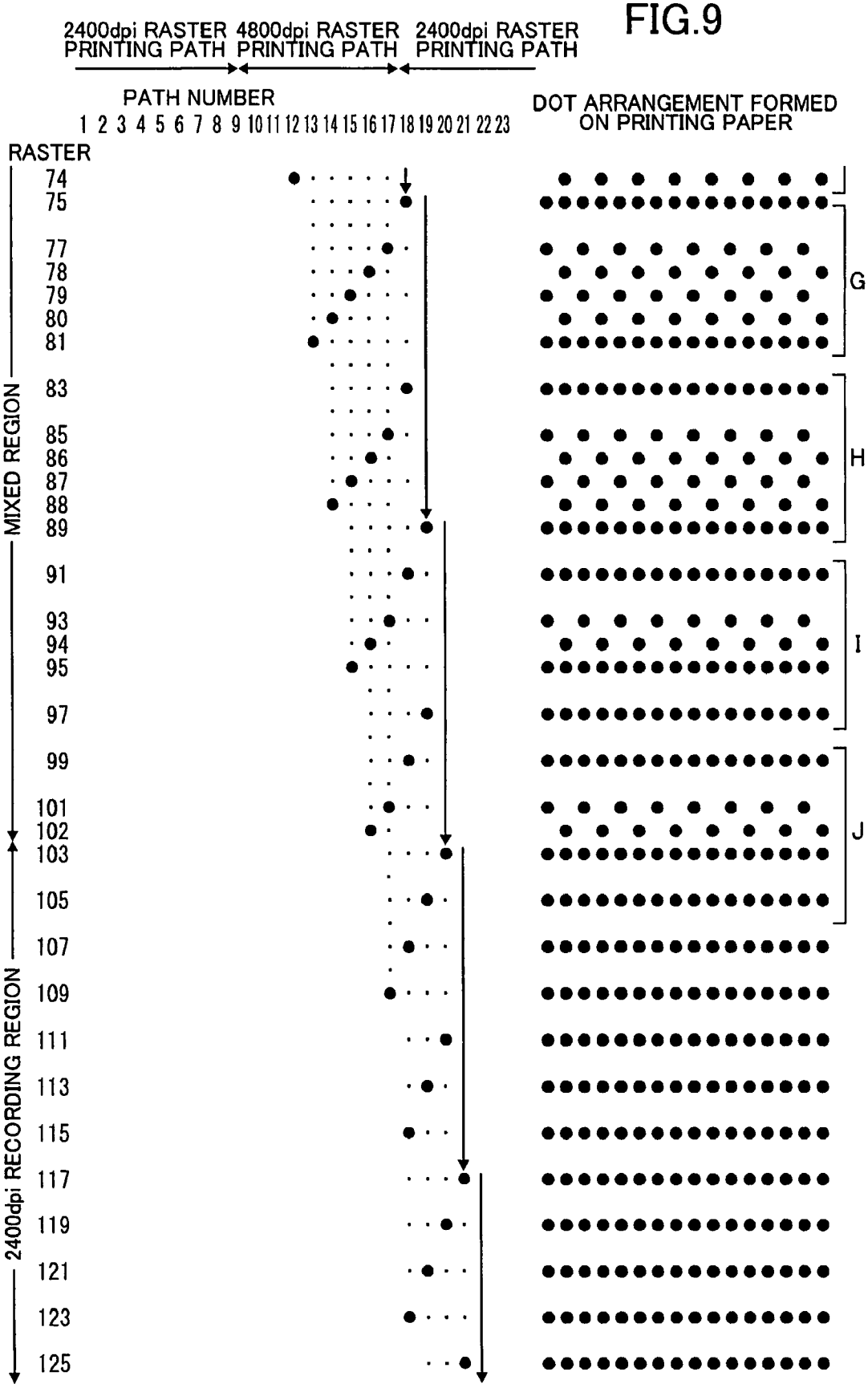
FIG. 9 illustrates the dot sorting method as a sequel to FIG. 8B.

Similarly to FIGS. 5A to 6B referred to in the first embodiment, FIGS. 8A to 9 each show the path forming each raster and each dot arrangement corresponding to each raster. Raster 39 as the last line shown in FIG. 8A is followed to raster 40 as the first line shown in FIG. 8B. Raster 73 as the last line shown in FIG. 8B is followed to raster 74 as the first line shown in FIG. 9.

As shown in FIGS. 8A and 8B, the range up to raster 5 is a region where dots are arranged at normal resolution. The range from raster 7 to raster 45 is a region where resolution gradually increases (first middle region). The range from raster 47 to raster 66 is a region where dots are arranged at double resolution (second middle region). The range from raster 67 to raster 105, extending from FIG. 8B to FIG. 9, is a region where resolution gradually decreases (third middle region).

In the first middle region and the third middle region, their resolution levels change according to the change of the ratio of the section having a higher resolution level and the section having a lower resolution level. Within the first middle region, the section from raster 7 to raster 13 shown as (A) and the section from raster 15 to raster 21 shown as (B), each have one raster line (raster 11 and raster 19) in which dots are arranged in a staggered layout at a higher resolution level. The rest raster lines arrange their dots at normal resolution. Next, the section from raster 23 to raster 29 shown as (C) and the section from raster 31 to raster 37 shown as (D) each have two raster lines (raster 25 and 27/raster 33 and 35) in which dots are arranged in a staggered layout at a higher resolution level. The following section from raster 39 to raster 45 shown as (E) has three raster lines (raster 39, 41, and 43) in which dots are arranged in a staggered layout at a higher resolution level. In other words, dots are arranged in the first middle region so as to increase the share for sections having a higher resolution level gradually toward the second middle region.

On the other hand, in the third middle region, the section from raster 67 to raster 74 shown as (F) has three raster lines (raster 69, 71, and 73) in which dots are arranged in a staggered layout at a higher resolution level.

Next, the section from raster 75 to raster 81 shown as (G) and the section from raster 83 to raster 89 shown as (H) each have two raster lines (raster 77 and 79/raster 85 and 87) in which dots are arranged in a staggered layout at a higher resolution level. Furthermore, the section from raster 91 to raster 97 shown as (I) and the section from raster 99 to raster 105 shown as (J) each have one raster line (raster 93 and raster101) in which dots are arranged in a staggered layout at a higher resolution level. In other words, dots are arranged in the third middle region so as to decrease the share for sections having a higher resolution level gradually with distance from the second middle region.

Referring now to FIG. 10, a description is given for the dot sorting process shown in FIGS. 8A to 9. FIG. 10 is a flow chart showing the dot sorting process. Regarding this flow chart, the steps the same as in the flow chart of FIG. 7 have the same step number, and their description is omitted here.

In Step S2, if a determination has been made that the relevant raster line does not belong to the printing region at double resolution (S2: No), a determination is further made whether the raster line belongs to the first middle region or the third middle region, both of which are mixed regions arranging dots both at normal resolution and at double resolution (S11). If a determination has been made that the raster line belongs to neither of the mixed regions (S11: No), which means that the raster line belongs to the region arranging dots at normal resolution, the process proceeds to Step S3 so as to set a mask for converting dots into a normal arrangement.

On the other hand, if the determination has been made that the raster line belongs to either of the mixed regions (S11: Yes), a determination is further made whether printing is to be performed at normal resolution or at double resolution for each raster line (S12). This determination may be made, for example, by pre-storing the information to be based on, as to which raster line has to be printed at double resolution in the ROM 33, or by computing. The determination by computing will be described later with reference to FIG. 11. Another determination is then made whether or not the raster line is to be printed at double resolution based on the previous determination result, if the determination has been made that the raster line is not to be printed at double resolution (S13: No), the process proceeds to Step S3. If the determination has been made that the raster line is to be printed at double resolution (S13: Yes), the process proceeds to Step S4.

Figure 11:
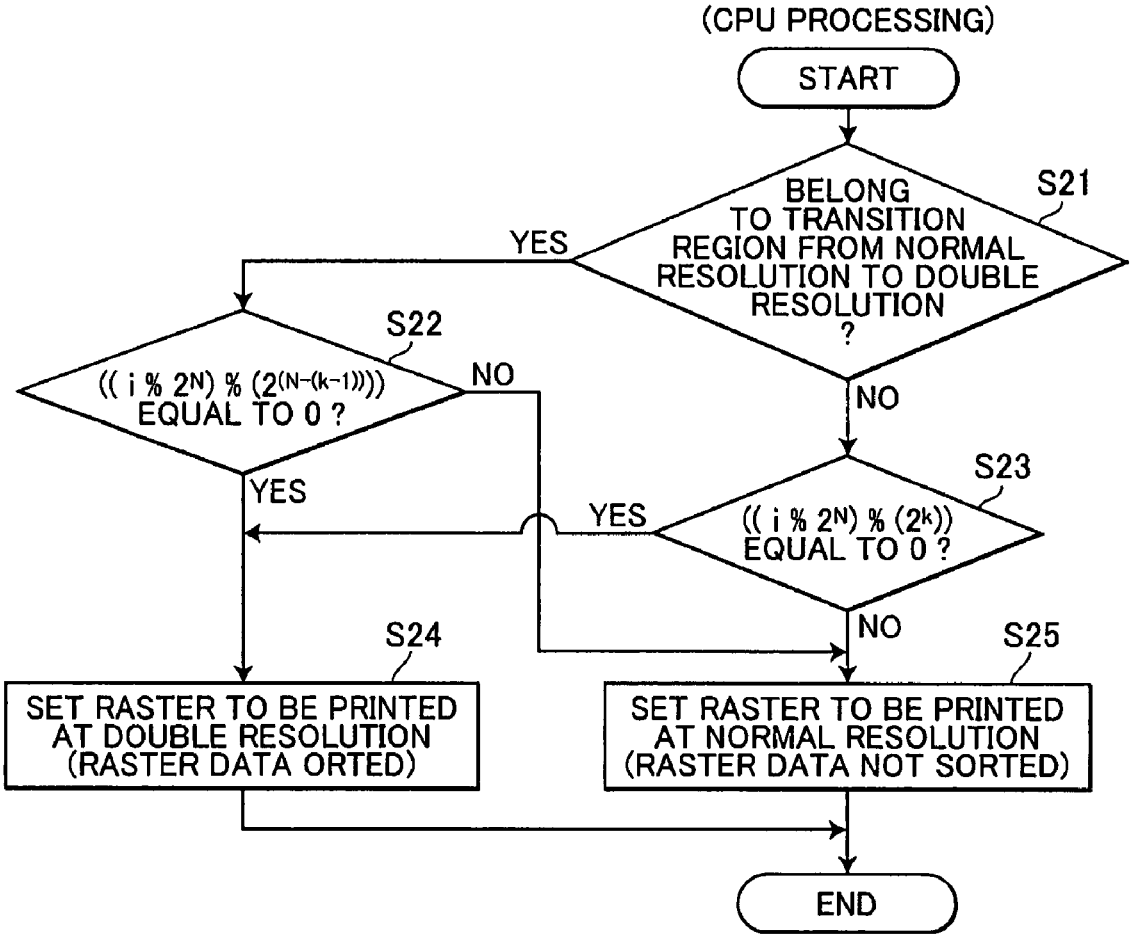
FIG. 11 is a flow chart showing a raster resolution setting process in a mixed region according to the second embodiment.

Referring next to FIG. 11, a description is given for the raster resolution determination by computing as Step S12 in the flow chart of FIG. 10. FIG. 11 is a flow chart showing the process of determining a raster resolution level. In this process, the mixed region is divided into N number of sub-regions in the feeding direction, and the i-th raster line within the k-th region is set either at normal resolution or at double resolution. In this setting method, in order to increase resolution gradually, raster lines are set to have a higher resolution level in the proportion of 2 raised to the (k−1)-th power/2 raised to the N-th power. For example, if the mixed region is divided into three sub-regions, one raster line out of eight raster lines is set to have a higher resolution level in the first sub-region; two raster lines out of eight raster lines are set to have a higher resolution level in the second sub-region; and four raster lines out of eight raster lines are set to have a higher resolution level in the third sub-region.

In the other hand, in the region where its resolution decreases gradually from the double resolution value, if the region is similarly divided into three sub-regions, four raster lines out of eight raster lines are set to have a higher resolution level in the first sub-region adjacent to the double resolution region; two raster lines out of eight raster lines are set to have a higher resolution level in the next sub-region; and one raster line out of eight raster lines is set to have a higher resolution level in the sub-region adjacent to the normal resolution region.

First, a determination is made whether or not the raster line to be processed belongs to the region (first middle region) being in transition from normal resolution to double resolution (S21). If the determination has been made that the raster line belongs to the first middle region (S21: Yes), the following computation is performed:

$$(i\%2^{N})\%(2^{(N-(k-1))}) \quad \text{[expression 1]}$$

A determination is made whether or not the value obtained by the computation is zero (S22). The notation "%" in the above expression is an operator to take the integer part of the quotient of the division. If the obtained value is zero (S22: Yes), the raster line is set to be printed at double resolution (S24). If the obtained value is not zero (S22: No), the raster line is set to be printed at normal resolution (S25).

In the determination step S21, if the raster line to be processed does not belong to the first middle region (S21: No), the determination is made that the raster line belongs to the third middle region, and the following computation is performed:

$$(i\%2^{N})\%(2^{(k)}) \quad \text{[expression 2]}$$

A determination is then made whether or not the value obtained by the computation is zero (S23). If the obtained value is zero (S23: Yes), the raster line is set to be printed at double resolution (S24). If the obtained value is not zero (S23: No), the raster line is set to be printed at normal resolution (S25).

As has been described above in the second embodiment, in the second middle region where a banding phenomenon occurs, dots are arranged at double resolution as well as in a staggered layout. By providing the first middle region being in transition from normal resolution to double resolution, and the third middle region being in transition from double resolution to normal resolution, it becomes possible to prevent the boundary between the region where dot are arranged in a staggered layout at double resolution, and the region where dots are normally arranged at normal resolution, from appearing as a line.

Therefore, even when a skip occurs during the sheet feeding process, the occurrence of a banding phenomenon and the distortion of an image due to resolution change are prevented, thereby achieving high quality printing. Further, it is only necessary to switch between the normal resolution section and the double resolution for setting a resolution level, which means control over the image forming device becomes simple.

While the invention has been described in detail with reference to the specific embodiment thereof, it would be apparent to those skilled in the art that various changes and modifications may be made therein without departing from the spirit of the invention.

For example, although the above embodiments relate to the process performed by a color inkjet printer, the process may be performed by other devices including a multi-functional device and a facsimile machine.

Although the above embodiments relate to the case in which printing is performed on a recording sheet as a recording medium, the present invention is not limited to paper. Examples of the applicable material include cloth and plastic.

Although the second embodiment relates to the process in which raster resolution is set by computing in the mixed region, the present invention is not limited to this process. The following process is also applicable. The mixed region is divided into N number of sub-regions in the feeding direction. Within the first middle region, raster data is sorted in the proportion of k/(N+1) in the k-th sub-region. Within the third middle region, raster data is sorted in the proportion of (N+1−k)/(N+1) in the k-th sub-region. For example, if the first middle region is divided into seven sub-regions, one raster line out of eight raster lines in the first sub-region, two out of eight in the second sub-region, three out of eight in the third sub-region, similarly, seven out of eight are set to have double resolution in the seventh region adjacent to the double resolution region, for a staggered arrangement.

Similarly, if third middle region is divided into seven sub-regions, seven raster lines out of eight raster lines in the first sub-region, six out of eight in the second sub-region, five out of eight in the third sub-region, similarly, one out of eight are set to have double resolution in the seventh region adjacent to the normal resolution region, for a staggered arrangement.

Though the resolution gradually increases in the first middle region in the above embodiment, the resolution in the first meddle region is fixed to a resolution higher than the normal resolution and lower than the double resolution.

What is claimed is:

1. An image forming device comprising:

a feeding unit including a first feeding member and a second feeding member disposed at a downstream of the first feeding member in a feeding direction, at least one of the first feeding member and the second feeding member feeding a recording medium in the feeding direction;

a recording unit disposed between the first feeding member and the second feeding member to eject a plurality of ink droplets onto the recording medium fed between the first feeding member and the second feeding member, the plurality of ink droplets ejected onto the recording medium forming a plurality of raster lines extending in a main-scanning direction orthogonal to the feeding direction; and a controller configured to control the recording unit to eject a plurality of ink droplets so that a plurality of first raster lines formed within a first time span has a first resolution in the feeding direction, a plurality of second raster lines formed within a second time span has a second resolution in the feeding direction, and a plurality of third raster lines formed within a third time span including a banding timing at which a trailing edge of the recording medium gets away from the first feeding member has a third resolution higher than the first resolution in the feeding direction, the second time span following the first time span and the third time span following the second time span, wherein the second resolution is higher than the first resolution and lower than the third resolution.

2. The image forming device according to claim 1, wherein the second resolution changes as the recording medium is fed.

3. The image forming device according to claim 2, wherein the plurality of second raster lines is segmented into a plurality of sections in the feeding direction, and the second resolution in each of the plurality of sections increases as the recording medium is fed.

4. The image forming device according to claim 3, wherein each section is composed of the first resolution and the third resolution, a ratio of the third resolution to the first resolution in the plurality of sections increasing as the recording medium is fed.

5. The image forming device according to claim 4, wherein the plurality of ink droplets ejected in the second time span and the third time span forms a plurality of dots on the recording medium to be in a staggered pattern.

6. The image forming device according to claim 2, wherein the plurality of second raster lines is segmented into a plurality of sections in the feeding direction, and the second resolution increased on a section basis as the recording medium is fed.

7. The image forming device according to claim 6, wherein each section is composed of the first resolution and the third resolution, a ratio of the third resolution to the first resolution in the plurality of sections increasing as the recording medium is fed.

8. The image forming device according to claim 7, wherein the plurality of ink droplets ejected in the second time span and the third time span forms a plurality of dots on the recording medium to be in a staggered pattern.

9. The image forming device according to claim 1, wherein the controller controls the recording unit to eject a plurality of ink droplets so that a plurality of fourth raster lines formed within a fourth time span following the third time span has a fourth resolution lower than the third resolution in the feeding direction.

10. The image forming device according to claim 9, wherein the fourth resolution decreases as the recording medium is fed.

11. The image forming device according to claim 1, wherein the second feeding member rotates faster than the first feeding member.

12. An image forming device comprising:

a feeding unit including a first feeding member and a second feeding member disposed at a downstream of the first feeding member in a feeding direction, at least one of the first feeding member and the second feeding member feeding a recording medium in the feeding direction;

a recording unit disposed between the first feeding member and the second feeding member to eject a plurality of ink droplets onto the recording medium fed between the first feeding member and the second feeding member, the plurality of ink droplets ejected onto the recording medium forming a plurality of raster lines extending in a main-scanning direction orthogonal to the feeding direction; and a controller configured to control the recording unit to eject a plurality of ink droplets so that a plurality of first raster lines formed within a first time span has a first resolution in the feeding direction, and a plurality of second raster lines formed within a second time span including a banding timing at which a trailing edge of the recording medium gets away from feeding by the first feeding member has a second resolution higher than the first resolution in the feeding direction, the second time span following the first time span, wherein the plurality of ink droplets ejected in the second time span forms a plurality of dots on the recording medium to be in a staggered pattern.

13. The image forming device according to claim 12, wherein the second feeding member rotates faster than the first feeding member.

14. An image forming device comprising:

a feeding unit including a first feeding member and a second feeding member disposed at a downstream of the first feeding member in a feeding direction, at least one of the first feeding member and the second feeding member feeding a recording medium in the feeding direction;

a recording unit disposed between the first feeding member and the second feeding member to eject a plurality of ink droplets onto the recording medium fed between the first feeding member and the second feeding member, a plurality of ink droplets ejected onto the recording medium forming a plurality of raster lines extending in a main-scanning direction orthogonal to the feeding direction, wherein the recording medium includes a first region, a second region adjacent to the first region in the feeding direction, and a third region adjacent to the second region in the feeding direction without being adjacent to the first region, the third region having a banding region on which the recording unit records the plurality of ink droplets when a trailing edge of the recording medium gets away from the first feeding member; and a controller configured to control the recording unit to eject a plurality of ink droplets so that a plurality of first raster lines formed on the first region has a first resolution in the feeding direction, a plurality of second raster lines formed on the second region has a second resolution in the feeding direction, and a plurality of third raster lines formed on the third region has a third resolution higher than the first resolution in the feeding direction, wherein the second resolution is higher than the first resolution and lower than the third resolution.

15. The image forming device according to claim 14, wherein the second feeding member rotates faster than the first feeding member.

16. An image forming device comprising:

a feeding unit including a first feeding member and a second feeding member disposed at a downstream of the first feeding member in a feeding direction, at least one of the first feeding member and the second feeding member feeding a recording medium in the feeding direction;

a recording unit disposed between the first feeding member and the second feeding member to eject a plurality of ink droplets onto the recording medium fed between the first feeding member and the second feeding member, a plurality of ink droplets ejected onto the recording medium forming a plurality of raster lines extending in a main-scanning direction orthogonal to the feeding direction, wherein the recording medium includes a first region, and a second region adjacent to the first region in the feeding direction, the second region having a banding region on which the recording unit records the ink droplets when a trailing edge of the recording medium gets away from the first feeding member; and a controller configured to control the recording unit to eject a plurality of ink droplets so that a plurality of first raster lines formed on the first region has a first resolution in the feeding direction, and a plurality of second raster lines formed on the second region has a second resolution higher than the first resolution, wherein the plurality of ink droplets ejected on the second region forms a plurality of dots on the recording medium to be in a staggered pattern.

17. The image forming device according to claim 16, wherein the second feeding member rotates faster than the first feeding member.

* * * * *